US006774757B2

(12) United States Patent
Fujiyoshi et al.

(10) Patent No.: US 6,774,757 B2
(45) Date of Patent: Aug. 10, 2004

(54) COIL

(75) Inventors: Toshikazu Fujiyoshi, Osaka (JP); Masao Katooka, Osaka (JP); Tetsuro Ikeda, Osaka (JP); Kenji Morimoto, Osaka (JP); Hideo Ishii, Osaka (JP)

(73) Assignee: Sansha Electric Manufacturing Company, Limited, Osaka (JP)

( * ) Notice: Subject to any disclaimer, the term of this patent is extended or adjusted under 35 U.S.C. 154(b) by 0 days.

(21) Appl. No.: 10/445,649

(22) Filed: May 27, 2003

(65) Prior Publication Data

US 2003/0222751 A1 Dec. 4, 2003

(30) Foreign Application Priority Data

May 27, 2002 (JP) ..... 2002-152117

(51) Int. Cl.[7] ..... H01F 5/00

(52) U.S. Cl. ..... 336/200; 336/223; 336/232; 336/206

(58) Field of Search ..... 336/200, 223, 336/206, 232; 29/602.1, 605

(56) References Cited

U.S. PATENT DOCUMENTS 5,559,487 A 9/1996 Butcher et al.
6,087,922 A * 7/2000 Smith ..... 336/223
6,211,767 B1 * 4/2001 Jitaru ..... 336/200

FOREIGN PATENT DOCUMENTS

| | | |
|---|---|---|
| EP | 0 608 127 A1 | 7/1994 |
| EP | 0 767 473 A1 | 4/1997 |
| GB | 2 369 251 A | 5/2002 |
| GB | 2 373 640 A | 9/2002 |

OTHER PUBLICATIONS

Yamanobe et al [US2003/005276A1], Coil for Electrical and Electronic Equipment as Well as Process for Production Thereof, Mar. 2003.*

* cited by examiner

*Primary Examiner*—Anh Mai
(74) *Attorney, Agent, or Firm*—Duane Morris LLP

(57) ABSTRACT

Metallic coils sheets (34, 36, 38) are planar and include center windows (34*a,* 36*a,* 38*a*). Slits (34*b,* 36*b,* 38*b*) extend outward through the respective sheets from the windows. Connection terminals (34*c,* 34*d;* 36*c,* 36*d;* 38*c,* 38*d*) are provided on the sheets at locations facing across the respective slits. The metallic coil sheets are stacked, and adjacent ones of the stacked metallic coil sheets are electrically connected by means of the connection terminals. A core (60, 62) is disposed in the windows of the stacked metallic coil sheets. The metallic coil sheets are individually covered with an insulating coating.

2 Claims, 6 Drawing Sheets

COIL

This invention relates to a coil that may be used, for example, as a component of a transformer or as a choke.

BACKGROUND OF THE INVENTION

The applicant of the present application filed U.S. patent application Ser. No. 10/006,478 on Dec. 6, 2001, entitled "High-Frequency Large Current Handling Transformer", which was published on Jun. 13, 2002 under US-2002-0070836-A1. The transformer disclosed in the U.S. application includes coil sheets or planar coil members 1, 2, 3, 4, 5 and 6 of metal, e.g. copper, as shown in FIG. 1. The metallic coil sheets 1, 2, 3, 4, 5 and 6 are formed in a rectangular shape with windows 1*a*, 2*a*, 3*a*, 4*a*, 5*a* and 6*a* in their center portions. One side of each coil sheet is cut to form a slit 1*b*, 2*b*, 3*b*, 4*b*, 5*b*, 6*b* therein. Tabs 1*c* and 1*d* extend outward from the portions facing across the slit 1*b*. Similarly, tabs 2*c* and 2*d*, 3*c* and 3*d*, 4*c* and 4*d*, 5*c* and 5*d*, and 6*c* and 6*d* extend outward from the portions of the respective sheet coils 2, 3, 4, 5 and 6 facing each other across the slits 2*b*, 3*b*, 4*b*, 5*b* and 6*b*. The tabs 1*c*, 2*c*, 3*c*, 4*c*, 5*c* and 6*c* provide winding start terminals, while the tabs 1*d*, 2*d*, 3*d*, 4*d*, 5*d* and 6*d* provide winding end terminals. The coil sheets 1, 2 and 3 are stacked, with the tabs 1*d* and 2*c* interconnected and with the tabs 2*d* and 3*c* interconnected, to thereby provide a primary winding of the transformer. Similarly, the coil sheets 4, 5 and 6 are stacked, with the tabs 4*c*, 5*c* and 6*c* interconnected and with the tabs 4*d*, 5*d* and 6*d* interconnected, to thereby provide a secondary winding. Insulating sheets 9, 10, 11 and 14 are disposed in such a manner that each coil sheets 1, 2 and 3 are sandwiched between two of the insulating sheets. An insulating sheet 17 is disposed on the stack of the coil sheets 4, 5 and 6 so as to sandwich them between the insulating sheets 17 and 14. The insulating sheets 9, 10, 11, 14 and 17 have center windows 9*a*, 10*a*, 11*a*, 14*a* and 17*a*, respectively. Two core halves of, for example, ferrite, 18 and 19 are used. The core halves 18 and 19 have center legs 18*a* and 19*a*, respectively, with grooves 18*b* and 18*c*, and 19*b* and 19*c* located on opposite sides of the respective legs 18*a* and 19*a*. Outward of the grooves 18*b* and 18*c* are outer legs 18*d* and 18*e*, respectively, and outward of the grooves 19*b* and 19*c* are outer legs 19*d* and 19*e*, respectively. The core halves 18 and 19 are combined in such a manner that the center legs 18*a* and 19*a* can be placed to extend through the center windows 1*a*–6*a* in the coil sheets 1–6 and the center windows 9*a*–14*a* and 17*a* in the insulating sheets 9–14 and 17.

In manufacturing this transformer, work for stacking the metallic coil sheets and the insulating sheets alternately is necessary, which increases the cost of the transformer. Furthermore, with this arrangement, the metallic coil sheets are exposed to air and, therefore, may be oxidized and rust after long use. In addition, in order to fulfill safety standards for transformers, it must be so arranged that a sufficient creepage distance can be kept even when the insulating sheets 9, 10, 11, 14 and 17 are displaced more or less with respect to is the metallic coil sheets. For that purpose, larger insulating sheets must be used, which makes transformers larger in size.

An object of the present invention is to provide a coil that requires fewer steps in manufacturing it, is hardly oxidized and is small in size.

SUMMARY OF THE INVENTION

A coil according to one embodiment of the present invention includes a coil section having a plurality of metallic coil sheets. The coil sheets are planar and each have a window in the center portion thereof. A slit is formed in each coil sheet, which extends from a location on the periphery of the window through the sheet to the outer periphery of the sheet. Connection terminals are formed on the sheet at locations facing each other across the slit. The coil sheets are stacked, and adjacent coil sheets are electrically connected with each other by the connection terminals. A core is disposed within the windows in the coil sheets. Each of the metallic coil sheets is individually coated completely with an insulating coating before the metallic coil sheets are stacked.

With the above-described arrangement, since each of the metallic coil sheet of the coil is individually pre-coated with an insulating coating, there is no need for placing an insulating sheet between adjacent coil sheets when the metallic coils sheets are stacked, which can reduce the manufacturing steps, which, in turn, can reduce the manufacturing cost. Furthermore, by covering the entire surface of each of the metallic coil sheets with an insulating coating, the metallic coil sheets are hardly oxidized and rusted. In addition, since each of the metallic sheets is individually pre-coated with an insulating coating, there is no need to take care to keep that insulating sheets are not displaced relative to the metallic coil sheets when the metallic coil sheets are stacked. Accordingly, it is not necessary to take such displacement into account when setting a creepage distance, and, therefore, the creepage distance can be set small. Then, the size of transformers can be reduced.

A plurality of coil sections may be used. The core is disposed to extend through the windows in the metallic coil sheets of the coil sections, so that the plural coil sections are inductively coupled with each other. This arrangement provides a transformer which can be manufactured at a low cost and hardly rust, and is small in size.

The insulating coatings may be formed by applying an insulative resin directly over the metallic coil sheet. Alternatively, an insulating film may be bonded to the metallic coil sheet to cover part of or the entirety of the surface of the metallic coil sheet before stacking the metallic coil sheets. The insulating resin may be used as an adhesive to bond the pre-formed insulating film to the metallic coil sheet.

DESCRIPTION OF EMBODIMENTS

Figure 2:
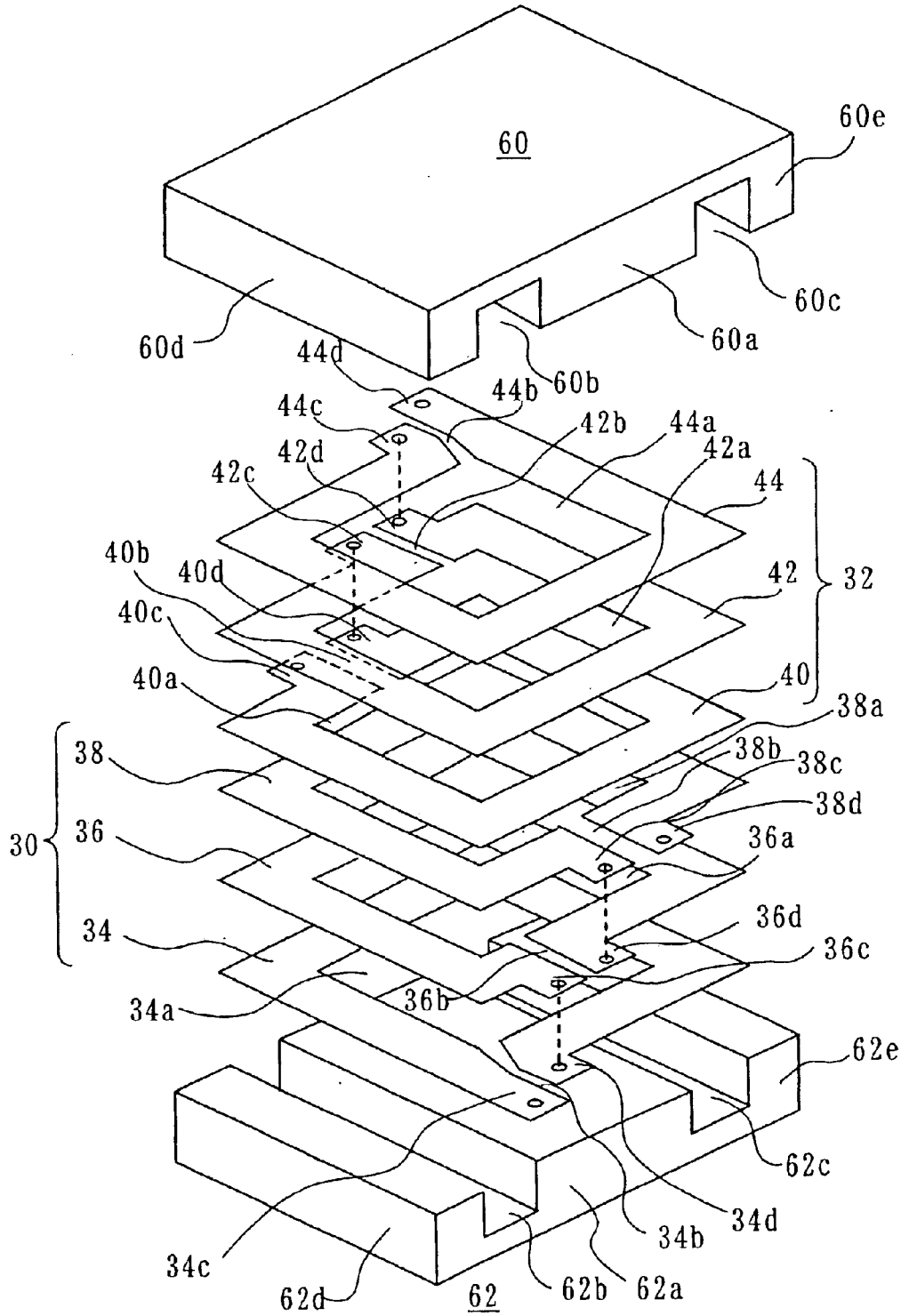
FIG. 2 is an exploded perspective view of a transformer according to a first embodiment of the present invention.

The present invention may be embodied in a high-frequency large current handling transformer, as shown in FIG. 2. The transformer includes a plurality, two, for example, of coil sections, or windings 30 and 32.

The winding 30 includes a plurality, three, for example, of metallic coil sheets 34, 36 and 38, which are formed in a rectangular shape and have the same size. The metallic coil sheets 34, 36 and 38 have windows 34*a*, 36*a* and 38*a*, respectively, in their center areas. The windows 34*a*, 36*a* and 38*a* have the same size. The metallic coil sheets 34, 36 and 38 are formed of metal, e.g. copper. Each of the coil sheets 34, 36 and 38 includes a slit 34*b*, 36*b*, 38*b* in one of the four sides around the window. The sides in which the slits are formed are on the same side of the completed transformer, but the locations of the slits 34*b*, 36*b* and 38*b* are offset with respect to each other. On the portions of the coil sheet 34 facing each other across the slit 34*b*, terminals 34*c* and 34*d* are provided. Similarly, terminals 36*c* and 36*d* and terminals 38*c* and 38*d* are provided on the portions of the coil sheets 36 and 38 facing each other across the respective slits 36*b* and 38*b*. The terminals 34*c*, 36*c* and 38*c* provide winding start terminals, and the terminals 34*d*, 36*d* and 38*d* provide winding end terminals. The metallic coil sheets 34, 36 and 38 are stacked up with the windows 34*a*, 36*a* and 38*a* therein aligned with each other. The locations of the slits 34*b*, 36*b* and 38 are determined such that, when the coil sheets are stacked, the terminals 34*d* and 36*d* are vertically aligned, and the terminals 36*d* and 38*c* are vertically aligned.

The winding 32 includes metallic coil sheets 40, 42 and 44 configured similarly to the metallic coil sheets 34, 36 and 38 of the winding 30. The metallic coil sheets 40, 42 and 44 have respective windows 40*a*, 42*a* and 44*a*, respective slits 40*b*, 42*b* and 44*b*, respective pairs of terminals 40*c* and 40*d*, 42*c* and 42*d*, and 44*c* and 44*d*. The metallic coil sheets 40, 42 and 44, too, are stacked in such a manner that the windows 40*a*, 42*a* and 44*a* therein are vertically aligned. The locations of the slits 40*b*, 42*b* and 44*b* are determined such that the terminals 40*d* and 42*c* can be vertically aligned and the terminals 42*d* and 44*c* can be vertically aligned when the metallic coil sheets 40, 42 and 44 are stacked.

Figure 4A:
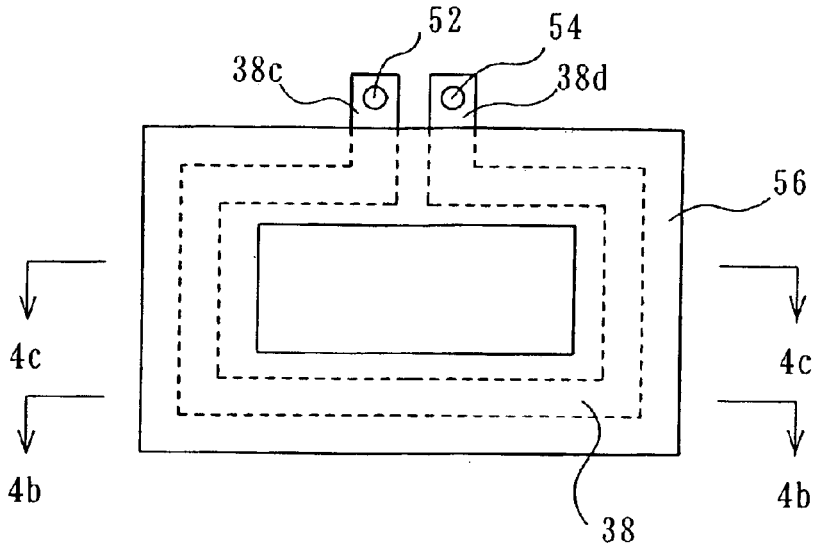
FIG. 4*a* is a plan view of a metallic coil sheet useable in the transformer of FIG. 2.
Figure 4B:
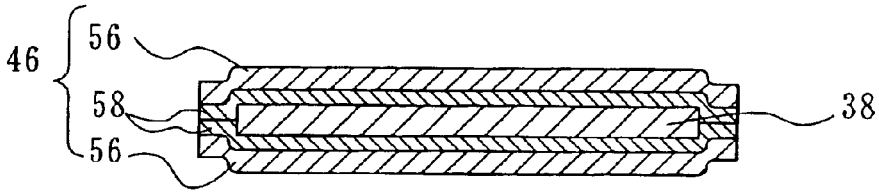
FIG. 4*b* is a cross-sectional view of the metallic coil sheet shown in FIG. 4*a* along a line 4*b*—4*b*.
Figure 4C:
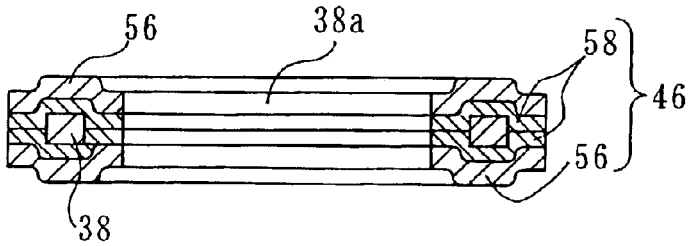
FIG. 4*c* is a cross-sectional view of the metallic coil sheet of FIG. 4*a* along a line 4*c*—4*c*.

Each of the metallic coil sheets 34, 36, 38, 40, 42 and 44 has an insulating coating (46) thereon, as represented by the metallic coil sheet 38 shown in detail in FIGS. 4*a*, 4*b* and 4*c*. The insulating coating 46 covers the entire surface of the metallic coil sheet 38. FIG. 4*b* is a cross-sectional view of the metallic coil sheet 38 with the insulating coating shown in FIG. 4*a* along a line 4*b*—4*b*, and FIG. 4*c* is a cross-sectional view along a line 4*c*—4*c*.

Figure 3A:
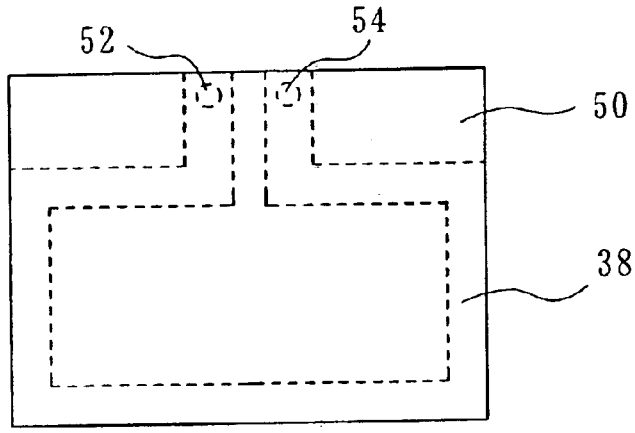
FIGS. 3*a*, 3*b*, 3*c* and 3*d* illustrate steps for manufacturing a metallic coil sheet useable in the transformer shown in FIG. 2.
Figure 3B:
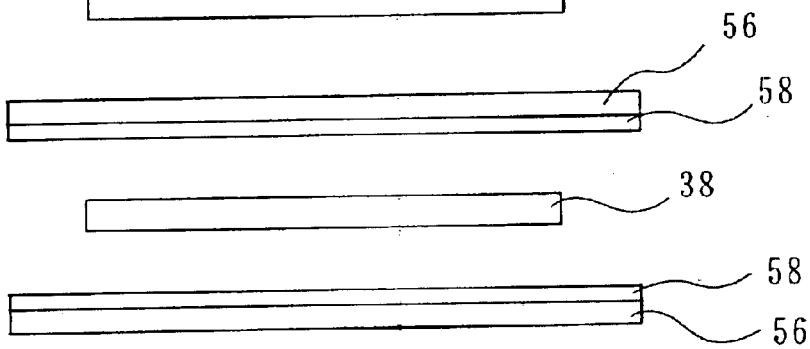

The insulating coating 46 is formed of an insulating film and an epoxy resin layer, and is formed in the following manner. First, the metallic coil sheet 38 is formed by punching a copper sheet 50 along broken lines, as shown in FIG. 3*a*. At this stage, holes 52 and 54 are also formed in the terminals 38*c* and 38*d*, respectively. Next, as shown in FIG. 3*b*, two insulating films, e.g. polyimide films 56 with an insulating adhesive layer, e.g. an epoxy resin layer 58, are prepared by applying epoxy resin over one surface of each polyimide film 56. The polyimide films 56 are rectangular and larger in size than the metallic coil sheet 38.

Figure 3C:
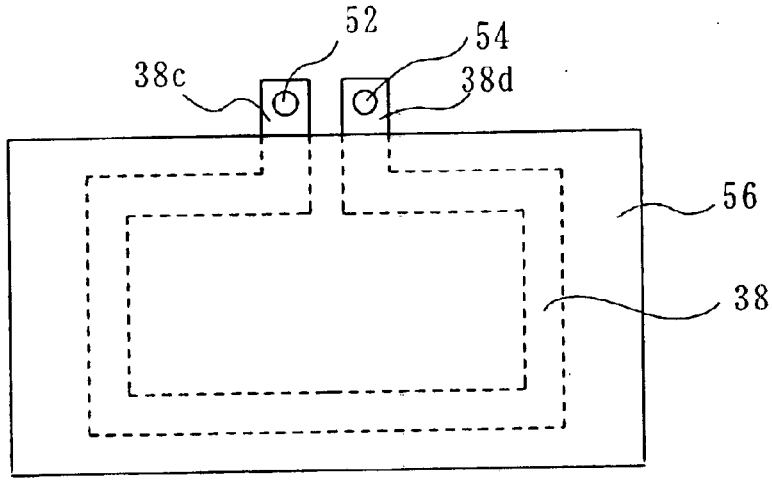

When the epoxy resin layers 58 are partly dried, the polyimide films 56 are joined to opposing two major surfaces of the metallic coil sheet 38, by placing, as shown in FIG. 3*c*, the epoxy resin layers 58 to contact with the major surfaces of the metallic coil sheet 38. Thus, the metallic coil sheet 38 is sandwiched. As is seen from FIG. 3*c*, the terminals 38*c* and 38*d* are not covered with the polyimide films 56.

Figure 3D:
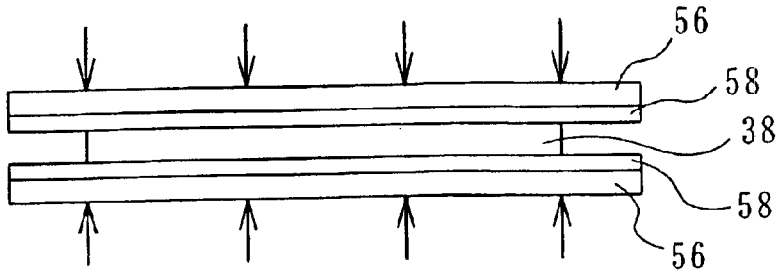

Then, as shown in FIG. 3*d*, downward and upward pressures are applied to the polyimide films 56 joined to the metallic coil sheet 38, by means of a press (not shown), e.g. a press with silicone rubber pressing surfaces, and the metallic coil sheet 38 and the polyimide films 56 are heated at a temperature between about 150° C. and about 180° C. for a time period of from three (3) hours to five (5) hours, to thereby cure the epoxy resin 58. After that, unnecessary peripheral and center portions of the polyimide films 56 and epoxy resin layers 58 are punched and removed, which results in the metallic coil sheet 38 with the polyimide films 56, shown in FIG. 4*a*. The holes 52 and 54 in the terminals 38*c* and 38*d* are used in positioning the metallic coil sheet 38 for this punching step. The other metallic coil sheets are also provided with an insulating coating in the same manner as described above. It should be noted that the thickness of the polyimide films 56 and epoxy resin layers 58 is exaggerated in FIGS. 3*a*–3*d* and 4*a*–4*c*.

The metallic coil sheets 34, 36 and 38 with the respective insulating coatings formed in the manner described above are stacked in such a manner that the terminal 36*c* is placed on the terminal 34*d* and the terminal 38*c* is placed on the terminal 36*d*, whereby the winding 30 is formed. Similarly, the metallic coil sheets 40, 42 and 44 with the respective insulating coatings formed in the manner described above are stacked such that the terminal 42*c* is placed on the terminal 40*d* and the terminal 44*c* is placed on the terminal 42*d*, whereby the winding 32 is formed. The terminals 34*d* and 36*c* of the winding 30 are electrically connected together, and also, the terminals 36*d* and 38*c* are electrically connected. Similarly, the terminals 40*d* and 42*c* of the winding 32 are electrically connected together, and the terminals 42*d* and 44*c* are electrically connected together.

The two windings 30 and 32 are stacked in such a manner that the windows 34*a*, 36*a*, 38*a*, 40*a*, 42*a* and 44*a* are vertically aligned, and cores 60 and 62 of, for example, ferrite, are placed to sandwich the vertically stacked windings 30 and 32. More specifically, the upper core 60 has a center leg 60*a*, two outer legs 60*d* and 60*e*, and grooves 60*b* and 60*c* between the center leg 60*a* and the outer leg 60*d* and between the center leg 60*a* and the outer leg 60*e*, respectively. Similarly, the lower core 62 has a center leg 62*a*, two outer legs 62*d* and 62*e*, and grooves 62*b* and 62*c* between the center leg 62*a* and the outer leg 62*d* and between the center leg 62*a* and the outer leg 62*e*, respectively. The center legs 60*a* and 62*a* are adapted to be placed into the windows 34*a*, 36*a*, 38*a*, 40*a*, 42*a* and 44*a*, and two opposing sides of each metallic coil sheet 34, 36, 38, 40, 42 and 44 are placed in the respective spaces defined by the grooves 60*b*, 60*c*, 62*b* and 62*c*, when the cores 60 and 62 are placed over the stacked windings 30 and 32 from above and below the stack.

Figure 1:
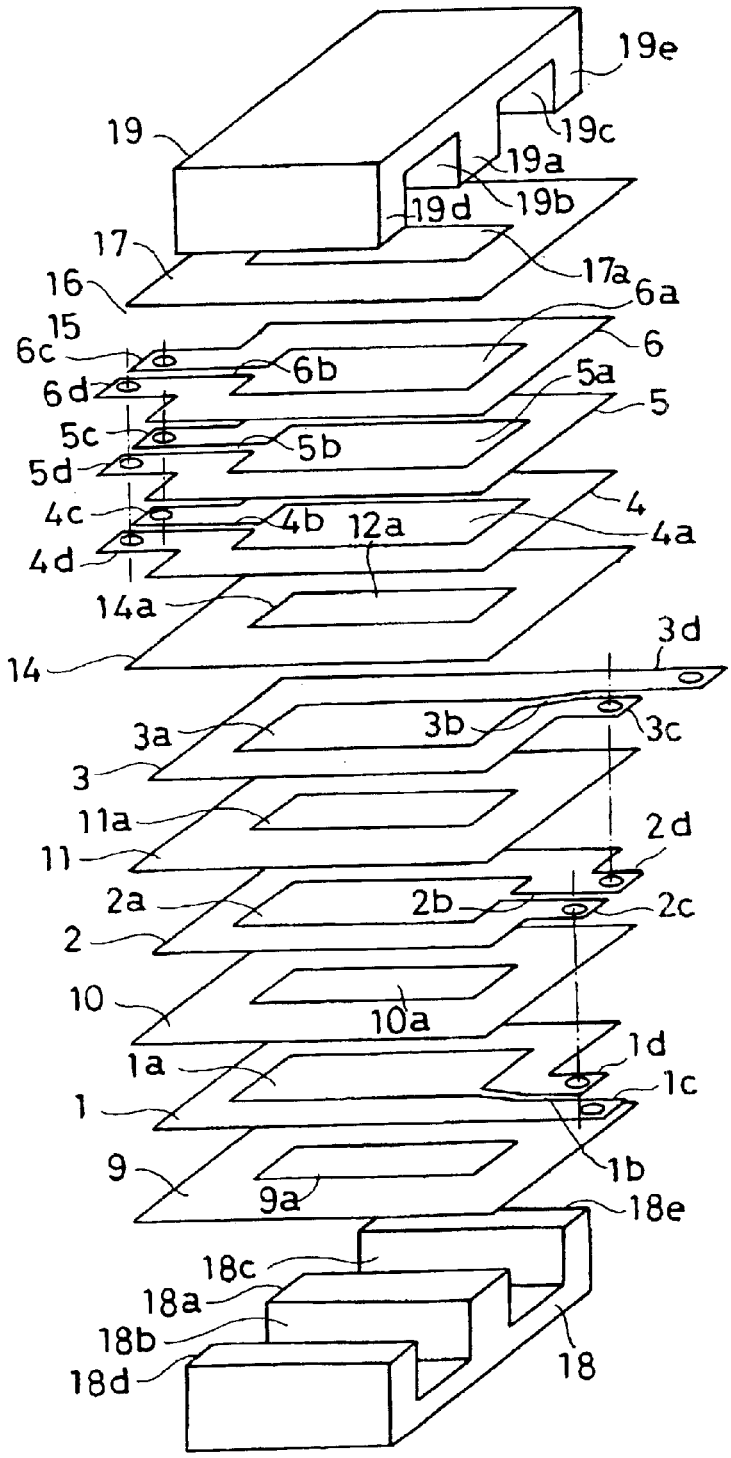
FIG. 1 Prior Art
FIG. 1 is an exploded perspective view of a prior art transformer.
Figure 5A:
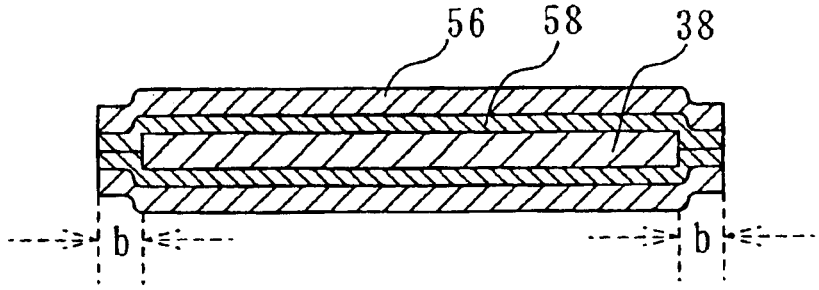
FIG. 5*a* is a cross-sectional view of a metallic coil sheet useable in the transformer of FIG. 2.
Figure 5B:
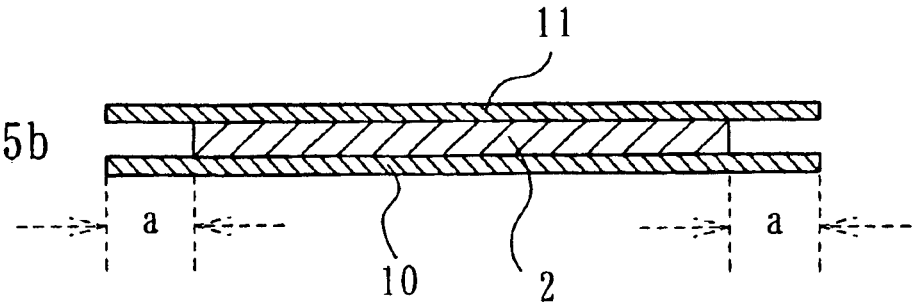
FIG. 5*b* is a cross-sectional view of a metallic coil sheet used in a prior art transformer.

FIG. 5*a* is a cross-sectional view of the metallic coil sheet 38 provided with the insulating coating 46. FIG. 5*b* is a cross-sectional view of the prior art metallic coil sheet 2 (FIG. 1) which does not have an insulating coating like the coating 46, but is insulated by means of the insulating sheets 10 and 11, for example. The metallic coil sheets 38 and 2 have the same size. As is understood from FIG. 5*b*, the prior art metallic coil sheet 2 requires larger insulating sheets so as to provide a larger creepage distance "a" in order to secure its necessary creepage distance when the position of the coil sheet 2 relative to the insulating sheets 10 and 11 is deviates from the nominal position. In contrast, according to the present invention, as shown in FIG. 5*a*, since the metallic coil sheet 38 is joined with the insulating coating 46, the creepage distance "b" can be only what is required and need not be longer than required. Shorter creepage distance can make it possible to downsize the transformer. Furthermore, since the metallic coil sheets are individually covered with the insulating coatings 56, working to place an insulating sheet between adjacent metallic coil sheets can be eliminated, which reduces the manufacturing cost. In addition, the insulating coatings 56 entirely covering the individual metallic coil sheets 38 can prevent the sheets 38 from rusting.

Figure 6:
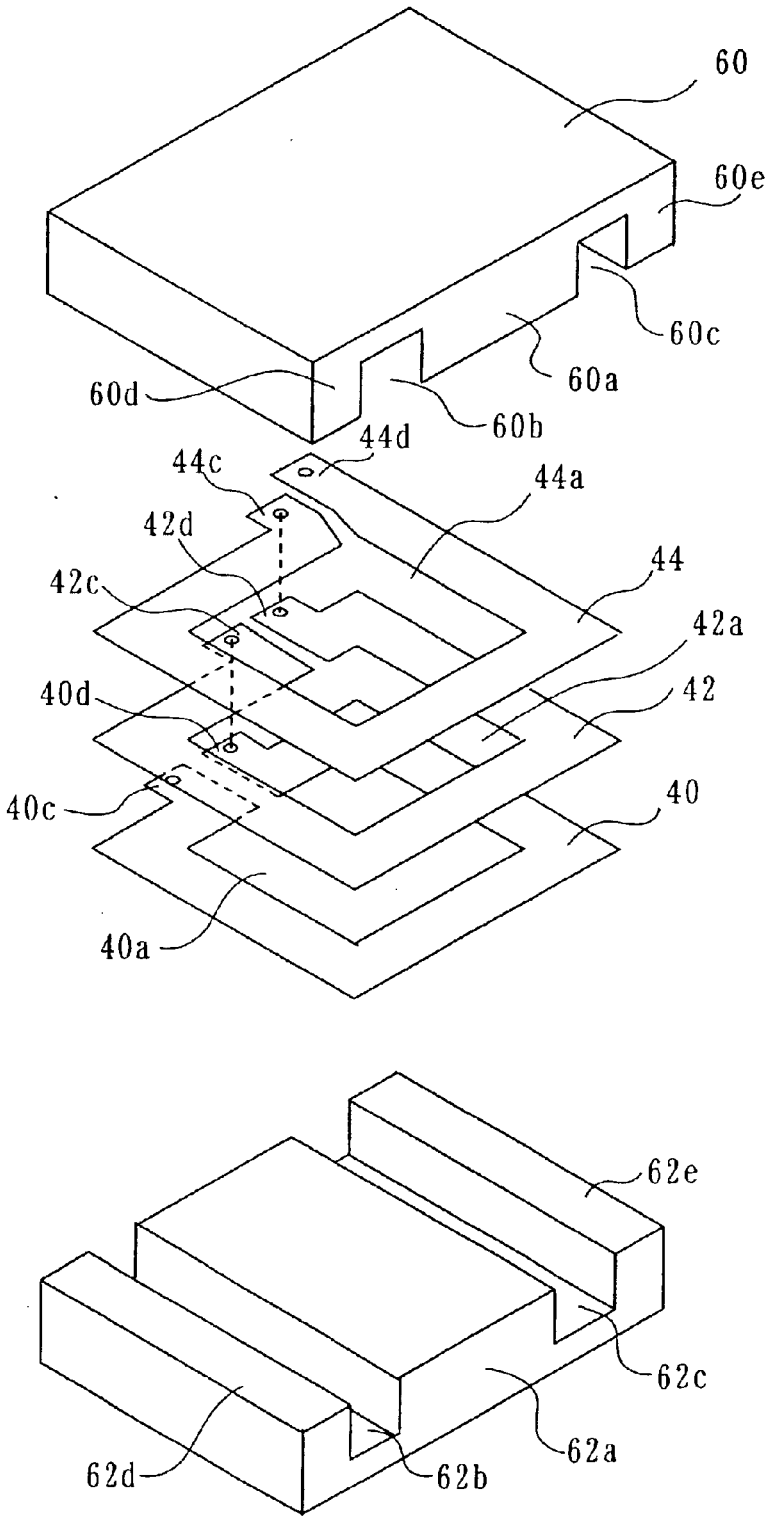
FIG. 6 is an exploded perspective view of a choke manufactured using a coil of the present invention.

FIG. 6 shows a coil according to the present invention as used for forming a high-frequency choke. The structure of the high-frequency choke show is same as that of the transformer shown in FIG. 2 from which the coil 30 is removed. Therefore, the same reference numerals as used in FIG. 2 are used for equivalent portions, and detailed description of the choke is not given.

In place of the two windings 30 and 32 used for the transformer shown in FIG. 2, more windings may be used so that a transformer with one primary winding and a plurality of secondary windings may be formed. In place of polyimide and epoxy, other materials may be used for the insulating films and insulating adhesive.

What is claimed is:

1. A coil comprising:

a coil section including a plurality of metallic coil sheets, each of said metallic coil sheets being planar, and having a center window and a slit extending from said window to an outer edge of said sheet, said metallic coil sheets each having connection terminals at locations facing each other across said slit, said plurality of metallic coil sheets being stacked, with adjacent ones of said stacked metallic coil sheets electrically connected with each other by means of said connection terminals; and a core disposed in said windows of said stacked metallic coil sheets;

wherein each of said metallic coil sheets is individually covered with an insulating coating before said metallic coil sheets are stacked; and each of said insulating coatings is bonded to an associated one of said coil sheets with an insulating adhesive.

2. A transformer comprising a plurality of said coil sections as defined by claim 1, with said core disposed in said windows of said stacked metallic coil sheets of said plurality of coil sections.

* * * * *